United States Patent [19]

Lyall et al.

[11] 4,205,958

[45] Jun. 3, 1980

[54] METHOD FOR THE MANUFACTURE OF MATCHES

[75] Inventors: Robert Lyall, Bracknell; Ian Maxwell, Reading; Valerie A. Buckle, Berkshire, all of England

[73] Assignee: Wilkinson Sword Limited, Buckinghamshire, England

[21] Appl. No.: 14,269

[22] Filed: Feb. 23, 1979

[30] Foreign Application Priority Data

Feb. 28, 1978 [GB] United Kingdom ..... 7904/78
May 31, 1978 [GB] United Kingdom ..... 25807/78

[51] Int. Cl.[2] ..... C06F 3/00; C06F 3/02; C06F 5/00

[52] U.S. Cl. ..... 44/42; 44/46; 44/47

[58] Field of Search ..... 44/42–47

[56] References Cited

U.S. PATENT DOCUMENTS

| | | | |
|---|---|---|---|
| 95,730 | 10/1869 | Rogers | 44/42 |
| 101,641 | 4/1870 | Meyer | 44/47 |
| 664,997 | 1/1901 | Fredrikson | 44/46 |
| 2,209,237 | 7/1940 | Simon et al. | 44/42 |
| 2,287,093 | 6/1942 | Ellis | 44/46 |

FOREIGN PATENT DOCUMENTS

| | | | |
|---|---|---|---|
| 1220093 | 1/1971 | United Kingdom | 44/46 |

*Primary Examiner*—Carl F. Dees
*Attorney, Agent, or Firm*—Kane, Dalsimer, Kane, Sullivan and Kurucz

[57] ABSTRACT

A method for the manufacture of matches which comprises applying to a match splint, before the formation thereon of the match head, a surface coating of an aqueous dispersion comprising (i) a low melting point solid fuel e.g. paraffin wax, (ii) a finely divided particulate or fibrous filler and (iii) either a water-immiscible volatile solvent for the fuel or a water-soluble or water-dispersible adhesive, or a mixture of the two; and thereafter drying the coated splint to deposit thereon adjacent the end thereof, on which the head is to be formed, a surface coating comprising a mixture of said fuel and said filler, and, if present, said adhesive.

9 Claims, 1 Drawing Figure

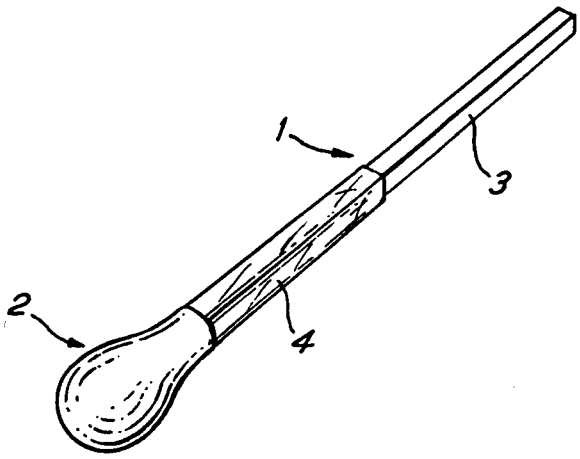
1
2
3
4

METHOD FOR THE MANUFACTURE OF MATCHES

BACKGROUND OF THE INVENTION

1. Field of the Invention

This invention relates to the manufacture of matches.

2. Brief Description of the Prior Art

Friction matches conventionally comprise a match stem or splint impregnated or coated with a fuel, e.g. paraffin wax and carrying a head formed from a match head composition which is ignitable by striking on a suitable surface.

Match splints have to meet a number of different requirements in order to be commercially acceptable. For example, they have to be sufficiently rigid to permit the match to be struck whilst holding the match some way away from the match head, they have to have a degree of toughness so that they do not break easily, they have to have sufficient porosity to absorb and retain the wax or other fuel which is used to fuel the flame, and moreover a porosity which permits the fuel to migrate through the pores during the burning process to fuel the flame, but without allowing droplets of fuel to drop from the burning match, and they must also preserve a large measure of their strength and toughness throughout the burning process so that hot or possibly still burning embers do not break or drop off.

Although non-wooden splints have been used and are used extensively in certain special applications, e.g. strips of card, particularly in the so-called book matches, and wax impregnated paper splints, and although many proposals have been made for synthetic or non-wooden splints, wooden splints are still extensively used in the match industry because of their unique combination of rigidty, toughness and porosity. Economic pressures in the timber industry are, however, creating a demand for a cheap substitute for the wooden match splint, a demand which has not so far satisfactorily been met by existing proposals for synthetic or substitute wooden splints.

The various proposals for synthetic or substitute wooden match splints include:

U.S. Pat. Nos. 2,495,575, 2,647,048 and 3,185,552 all of which disclose paper or board splints stiffened by impregnation with resinous or plastics materials of various kinds; Japanese Patent Publications Nos. 74-21 042, 74-21 043 and 74-21 044 which disclose plastics match splints comprising a plastics binder in combination with various fillers;

Japanese Patent Publications Nos. 73-38 346 and 74-59 157 which disclose matchsticks formed from a moulded cellulose material;

U.K. Patent No. 862,932 which discloses match splints composed of an extruded combustible mixture of finely divided vegetable material e.g. paper pulp, wood pulp, sawdust with a synthetic material such as cellulose acetate, with or without additional agglutinants, impregnating agents and fillers; and U.K. Patent No. 882,713 which discloses match splints composed of an outer combustible shell and an inner at least partly combustible core, the shell and the core both being formed from combustible materials such as wood pulp, paper, sawdust, if necessary with an agglutinant such as starch or glue which binds the particulate material together to form a substantially rigid, self-supporting structure.

SUMMARY OF THE INVENTION

The present invention differs from the foregoing proposals in divorcing the functions of rigidity and porosity and is based on the surprising discovery that if a mixture of low melting point solid fuel e.g. paraffin wax and a finely divided particulate or fibrous filler, additionally containing either a volatile solvent for the fuel or a water-soluble or water-dispersible adhesive or a mixture of the two, is applied as an aqueous dispersion to the surface of the match stem, which may be non-combustible and substantially non-porous, and allowed to dry thereon prior to formation of the match head, a match is obtained which burns at a controlled rate, and moreoever burns without the formation of droplets of molten wax. Thus, the present invention provides for controlled fuelling of the flame divorced from the porosity of otherwise of the stem itself. This invention therefore opens up the possibility of using a wide range of cheap natural or synthetic materials as match splints which have hitherto been ruled out because the porosity characteristics of the material have not been acceptable even though suitable in other respects.

BRIEF DESCRIPTION OF THE DRAWING

The accompanying drawing is a view-in-perspective of an embodiment match of the invention.

DETAILED DESCRIPTION OF THE PREFERRED EMBODIMENTS OF THE INVENTION

In accordance with the present invention therefore, there is provided a method for the manufacture of match splints, which comprises applying to the splint, for example, by dipping, painting or spraying, an aqueous dispersion comprising (i) a solid low melting point solid fuel, e.g. a hydrocarbon fuel such as paraffin wax, (ii) a finely divided particulate or fibrous filler, and (iii) either a water-immiscible solvent for the fuel or a water-soluble or water-dispersible adhesive or both and allowing the dispersion to dry thereon, thereby to form a surface coating comprising the fuel and the filler in admixture and optionally containing said adhesive, said coating extending along at least a portion of the length of the splint adjacent one end thereof. Thereafter, the head can be formed on the coated splint in a conventional manner, e.g. by dipping the coated end of the splint in an aqueous match-head composition, thereby to form a bulb of the friction ignitable match head composition on the end of the splint.

The particulate or fibrous material used in the coating layer may be of a combustible or non-combustible material and may be porous or substantially non-porous. Porous fillers are however preferred e.g. fibrous filler materials such as chopped newsprint, cotton, jute, cardboard and chopped synthetic fibre. The preferred particulate filler is ungelatinized starch, but other fillers, e.g. ground peat, sawdust, talc and china clay may also be used.

In the case of the preferred fibrous fillers, such as chopped newsprint, cotton rag or jute, fibre lengths may range from 0.1 to 1.0 mm and diameters from 5–80 μm, but these dimensions are not critical. Likewise, the particle size of the particulate materials is not critical and may range from 1–200 μm.

In order to disperse the fuel in the aqueous medium, a surfactant, usually an anionic or non-ionic surfactant, will usually be required, as will readily be apparent to the skilled reader.

A variety of solid, low-melting point, water-dispersible fuels may be used, but usually, and as is customary in the art, the fuel of choice will be a hydrocarbon wax e.g. paraffin wax of m.p. in the range 45°-70° C. Long chain fatty acids (14–20 carbon atoms) e.g. stearic acid, may also be used, optionally in admixture with paraffin wax. A particularly preferred fuel is a mixture of paraffin wax and stearic acid, since it is found that the presence of such a long chain fatty acid substantially increases the subsequent adhesion of the match head to the splint. Mixture ratios of long chain fatty acid to paraffin wax may range from 10:90 to 90:10, preferably about 50:50. Other methods of promoting head adhesion are available, e.g. by roughening the surface of the splint before dipping in the match head composition or by building up the head by a multiple, e.g. double, dipping process.

The third essential component of the aqueous dispersions used in this invention, apart from water, is a water-immiscible volatile solvent for the fuel or, alternatively, a water-soluble or water-dispersible adhesive. The water-immiscible volatile solvent, which may be a liquid hydrocarbon such as xylene, or a petroleum distillate e.g. kerosene or white spirit, serves as a coalescing agent for the dispersed fuel particles during the drying process thereby to obtain a coherent coating of the fuel on the splint. Alternatively there can be used a water-dispersible or water-soluble adhesive to serve as a binder for the deposited fuel particles and the finely divided fibrous or particulate filler.

The type of adhesive is not critical, although adhesives giving off noxious odours on burning should be avoided. Water-based adhesives such as starch or modified starch adhesives, dextrins and carboxymethylcellulose are preferred, or inorganic silicates depending on the material of the core and on the composition of the particles or fibrous material forming the surface layer.

If desired, a coalescing agent, i.e. the water-immiscible volatile solvent, can be used in conjunction with a water-soluble or water-dispersible adhesive.

Coating weight and thickness will be determined by a number of factors e.g. the dimensions of the splint and the type of coating material, but more particularly the type and amount of fuel which is to be applied. On a splint of conventional match dimensions, such as, for example a 1.9 mm square, coating weights will preferably be such as to provide about 15 mg of fuel per cm of the coated splint length. However, it is a particular feature of this invention that high fuel loadings can be obtained provided that a sufficiently high proportion of filler is present to prevent drop formation during the burning process.

The length of the splint covered by the surface coating will be variable depending on the dimensions of the stem itself, the thickness of the coating and the quantity of wax or other fuel that it is desired to provide on the splint. The coating may extend the whole length of the splint or only along part of its length adjacent one end, e.g. the length of splint covered by the coating may only be 1–2 cm on a splint of conventional length of 3–4 cms.

A variety of materials may be used as the splint provided that they have the requisite strength and toughness, e.g. wood, glass, metal, plastics. However, as already pointed out, it is a particular advantage of this invention that the porosity of the splint is immaterial and that substantially non-porous materials can be used, or materials which may not have the requisite radial, as well as axial porosity, which has hitherto been essential in match splints to permit the impregnated fuel to migrate both axially and radially of the splint during the burning process in order to provide a steady flow of fuel to the flame, thereby ensuring a substantially constant flame height. Especially preferred by reason of low cost are composite material comprising a fibrous filler such as chopped newsprint, cotton waste or jute, in admixture with an adhesive or resin binder which can be extruded or otherwise shaped into splints or the appropriate length.

In depositing the fuel/filler coating on the splint, the aqueous dispersion will generally contain, on a volume basis, 20–75% water, preferably 20–30%; 15–35% fuel, preferably 20–30%; and 10–60% filler, preferably 2050%. In the case of dispersions employing a volatile solvent, this will generally be used in amounts up to 25% by weight, based on the weight of the fuel, preferably 10–20%. In the case of dispersions employing an adhesive, this will generally be used in amounts, on a volume basis, of 1–10%, preferably 1–5%. Surfactant concentrations will generally be in the range 0.1 to 5.0% by volume, preferably 0.1 to 1.0%. Particularly useful formulations employing (a) an adhesive and (b) a volatile solvent are as follows, the percentages are on a volume basis:

| A | B |
|---|---|
| 25% paraffin wax | 37% paraffin wax |
| 25% water | 37% water |
| 2% starch gel adhesive | 18% maize starch (filler) |
| 47% fibrous filler | 7% white spirit |
| 1% surfactant* | 1% surfactant* |

*an anionic surfactant containing 40% active ingredient, sodium alkyl naphthalene sulphonate The aqueous dispersion containing the fuel, the filler and the solvent or adhesive may be applied to the splint by any suitable technique e.g. by painting or spraying, but most usually and conveniently by dipping. The quantity applied will vary widely depending on the porosity of the splint, the overall dimensions and the type of fuel. For the conventionally sized match splint, e.g. 2.3×2.3 mm in cross-section, the amount of paraffin wax applied may suitably range from 5 mg to 40 mg of wax per centimeter of coating length, preferably about 15 mg.

Following application of the coating, the match head composition may be applied in a conventional manner, such as by dipping. The compositions and techniques for doing this are quite conventional and form no part of this invention. They therefore do not need to be described further.

A typical match manufactured in accordance with this invention is illustrated in the accompanying drawing.

The match comprises a splint 1 according to this invention having a head 2 formed thereon of a conventional match head composition which may either be of the safety or strike anywhere type.

The splint itself comprises a rigid core or stem 3 which extends the length of the splint and the end of which is embedded in the match head composition. The core 3 is of any suitably rigid and tough material, e.g. wood, plastics, glass or a composite material such as sawdust, chopped newsprint, chopped cotton rag, jute or any other waste fibrous material bonded with a suitable bonding agent e.g. starch or a synthetic plastics resin, and extruded or otherwise shaped to provide a suitably sized core.

A particularly preferred material for the core is a wood substitute composition comprising a blend of hydrophilic and hydrophobic fibres bonded together and oriented along a common axis, in this case, the axis of the match stem, in a matrix of granular starch and a hydrophilic polymer binder and containing in addition up to 6% by weight (dry solids basis) of a cross-linking agent capable of reacting in an acid catalysed reaction with the starch component of the matrix and thereby to insolubilize the starch.

The fibre blend constitutes from 30–80% by weight, dry solids basis, of the total compositiion with the hydrophilic fibres constrituting the major proportion, preferably 90–99.9% by weight of the blend. The preferred fibrous blend is a blend of waste cellulosic fibres such as chopped paper, newsprint, bagasse, straw, sawdust or cotton with synthetic hydrophobic fibres such as polyolefin, polyamide, or polyester fibres. The preferred hydrophilic binders are natural polymers such as gluten, zein, casein and soluble starch or solubilized starch derivatives including mechanically damaged starch granules. Preferred cross-linking agents are formaldehyde and paraformaldehyde in amounts of from 1–3% by weight. The preferred matrix for the fibre blend comprises a granular starch and a natural hydrophilic polymer derived from a common source preferably from a cereal flour or a root crop flour.

Adjacent the head end of the match, the surface of the core is coated with a coating 4 formed by dipping the splint, before formation of the head, in an aqueous dispersion of the fuel, e.g. paraffin wax, and the filler, e.g. china clay, and containing either a water-immiscible volatile solvent, e.g. white spirit, and/or the adhesive, e.g. starch.

Matches produced in accordance with this invention have advantages of cheapness as they can be produced largely from waste materials by simple mass production techniques. Moreover, by suitable selection of the materials used in the coating fuel uptake can be closely controlled to give optimum burning characteristics e.g. height of flame and burning time without detriment to other factors such as rigidity, strength and touchness of the core.

Of course, a variety of additives conventional in the match making art may be added either to the core or to the coating or to the fuel for specific purposes. For example, fire retardants may be incorporated in the core or in the coating to reduce after glow, metal salts can be added to give coloured flames, and dyes or other colourants may be used to colour any or all of the components of the match, and microcrystalline or other waxes or polymers may be added to the paraffin wax or other fuel to modify the properties thereof e.g. viscosity and melting point and hardness, as may be desired.

We claim:

1. In a method for the manufacture of matches which comprises applying to a match splint a head of a composition ignitable by striking on a surface and a low melting point solid fuel, the improvement which comprises applying the fuel to the splint by coating the splint, before formation of the head thereon, with an aqueous dispersion containing (i) the fuel dispersed in the aqueous phase, (ii) a finely divided particulate or fibrous filler and (iii) a water-soluble or water-dispersible adhesive, and drying the coated splint to deposit thereon a surface coating comprising a mixture of said fuel, said filler and said adhesive.

2. A method according to claim 1, wherein the filler is chopped newsprint, cotton, jute, cardboard or chopped synthetic fibre, or a finely divided particulate ungelatinised starch.

3. A method according to claim 1, wherein the adhesive is starch or a modified starch, a dextrin or carboxymethylcellulose.

4. A method according to claim 1, wherein the fuel is paraffin wax.

5. A method according to claim 4, wherein the fuel is a mixture of paraffin wax and a long chain fatty acid having a chain length of from 14–20 carbon atoms in weight ratio 90:10 to 10:90.

6. A method according to claim 1, wherein the splint is formed from a wood substitute composition comprising a fibrous filler and an adhesive or resin binder.

7. A method according to claim 6, wherein the splint is formed from a blend of hydrophilic fibres, in major proportion by weight, and a minor proportion by weight of hydrophobic fibres bonded together and oriented along a common axis in a matrix of granular starch and a hydrophilic polymer binder, and containing up to 6% by weight (dry solids basis) of a cross-linking agent capable of reacting in an acid catalysed reaction with the starch component of the matrix.

8. A match comprising a match splint, a combustible head formed from a match head composition ignitable by striking the head on a surface and a solid low melting point fuel, wherein the fuel is carried on the surface of the splint as a surface coating comprising the fuel in admixture with (a) a finely divided particulate or fibrous filler, and (b) a water-soluble or water-dispersible adhesive.

9. A match comprising a splint, a combustible head formed from a match head composition ignitable by striking said head on a surface and a solid low melting point fuel, wherein the fuel is provided on said splint by coating the splint, before formation of the head thereon, with an aqueous dispersion containing (i) the fuel dispersed in the aqueous phase, (ii) a finely divided particulate or fibrous filler and (iii) a water-soluble or water-dispersible adhesive, and drying the coated splint to deposit thereon a surface coating comprising a mixture of said fuel, said filler and said adhesive.

* * * * *

UNITED STATES PATENT AND TRADEMARK OFFICE

CERTIFICATE OF CORRECTION

PATENT NO. : 4,205,958

DATED : June 3, 1980

INVENTOR(S) : Robert Lyall et al

It is certified that error appears in the above-identified patent and that said Letters Patent are hereby corrected as shown below:

At Column 4, line 18; - "2050%" should read -- 20-50% --

Signed and Sealed this

*Twenty-sixth* Day of *August 1980*

[SEAL]

*Attest:*

SIDNEY A. DIAMOND

*Attesting Officer*

*Commissioner of Patents and Trademarks*